US010295942B1

(12) United States Patent
Hashimoto

(10) Patent No.: US 10,295,942 B1
(45) Date of Patent: May 21, 2019

(54) IMAGE FORMING APPARATUS AND METHOD OF CONTROLLING AN IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotemba Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/920,991

(22) Filed: Mar. 14, 2018

(51) Int. Cl.

| | |
|---|---|
| ***B65H 1/26*** | (2006.01) |
| ***B65H 1/04*** | (2006.01) |
| ***G03G 15/00*** | (2006.01) |
| ***B65H 7/04*** | (2006.01) |

(52) U.S. Cl.
CPC ..... *G03G 15/5016* (2013.01); *B65H 1/04* (2013.01); *B65H 1/266* (2013.01); *B65H 7/04* (2013.01); *G03G 15/553* (2013.01); *G03G 15/6514* (2013.01); *B65H 2220/01* (2013.01); *B65H 2405/11* (2013.01); *B65H 2511/511* (2013.01); *G03G 2215/00616* (2013.01)

(58) Field of Classification Search
CPC ..... B65H 2511/511; B65H 7/04; B65H 7/14; B65H 7/20; B65H 7/02; B65H 1/266; B65H 1/04
See application file for complete search history.

(56) References Cited

U.S. PATENT DOCUMENTS

| | | | | |
|---|---|---|---|---|
| 5,602,625 | A | 2/1997 | Okamoto et al. | |
| 9,376,277 | B2 * | 6/2016 | Ayash | B65H 1/266 |
| 2015/0183608 | A1 * | 7/2015 | Onishi | B65H 31/24 358/1.15 |
| 2017/0272593 | A1 * | 9/2017 | Kamiya | G03G 15/5016 |
| 2018/0275576 | A1 * | 9/2018 | Maruyama | G03G 15/50 |

FOREIGN PATENT DOCUMENTS

| | | | |
|---|---|---|---|
| JP | 06080274 | A * | 3/1994 |
| JP | 2002037485 | A * | 2/2002 |
| JP | 2003163770 | A * | 6/2003 |
| JP | 2004250234 | A * | 9/2004 |
| JP | 2005049415 | A * | 2/2005 |

* cited by examiner

*Primary Examiner* — Luis A Gonzalez
(74) *Attorney, Agent, or Firm* — Kim & Stewart LLP

(57) ABSTRACT

An image forming apparatus includes an image forming unit configured to form an image on a sheet, a cassette configured to accommodate sheets to be supplied to the image forming unit, an opening mechanism configured to open the cassette, a motion sensor configured to detect a motion of a person, and a processor configured to control the opening mechanism to open the cassette in response to the motion sensor detecting a specific motion of a person.

18 Claims, 7 Drawing Sheets

IMAGE FORMING APPARATUS AND METHOD OF CONTROLLING AN IMAGE FORMING APPARATUS

FIELD

Embodiments described herein relate generally to an image forming apparatus and a method of controlling an image forming apparatus.

BACKGROUND

For an image forming apparatus having a cassette which accommodates one or more sheets on which images are formed, an operation for feeding sheets to the cassette to refill the cassette needs to be performed, when the cassette has no more sheets. According to a conventional image forming apparatus in the related art, a user withdraws the cassette from an apparatus body, and sets one or more sheets in the withdrawn cassette in order to fill the empty cassette. However, the sheet feeding operation performed by the user is troublesome. For example, in order to withdraw the cassette, the user, who may be initially holding the sheets to be fed with both hands, has to withdraw the cassette. To do so, the user may have to temporarily place the held sheets somewhere beforehand in order to free the user's hands so that cassette may be withdrawn.

DETAILED DESCRIPTION

According to an embodiment, an image forming apparatus includes an image forming unit configured to form an image on a sheet, a cassette configured to accommodate sheets to be supplied to the image forming unit, an opening mechanism configured to open the cassette, a motion sensor configured to detect a motion of a person, and a processor configured to control the opening mechanism to open the cassette in response to the motion sensor detecting a specific motion of a person.

Hereinafter, the embodiment will be described with reference to the drawings.

Figure 1:
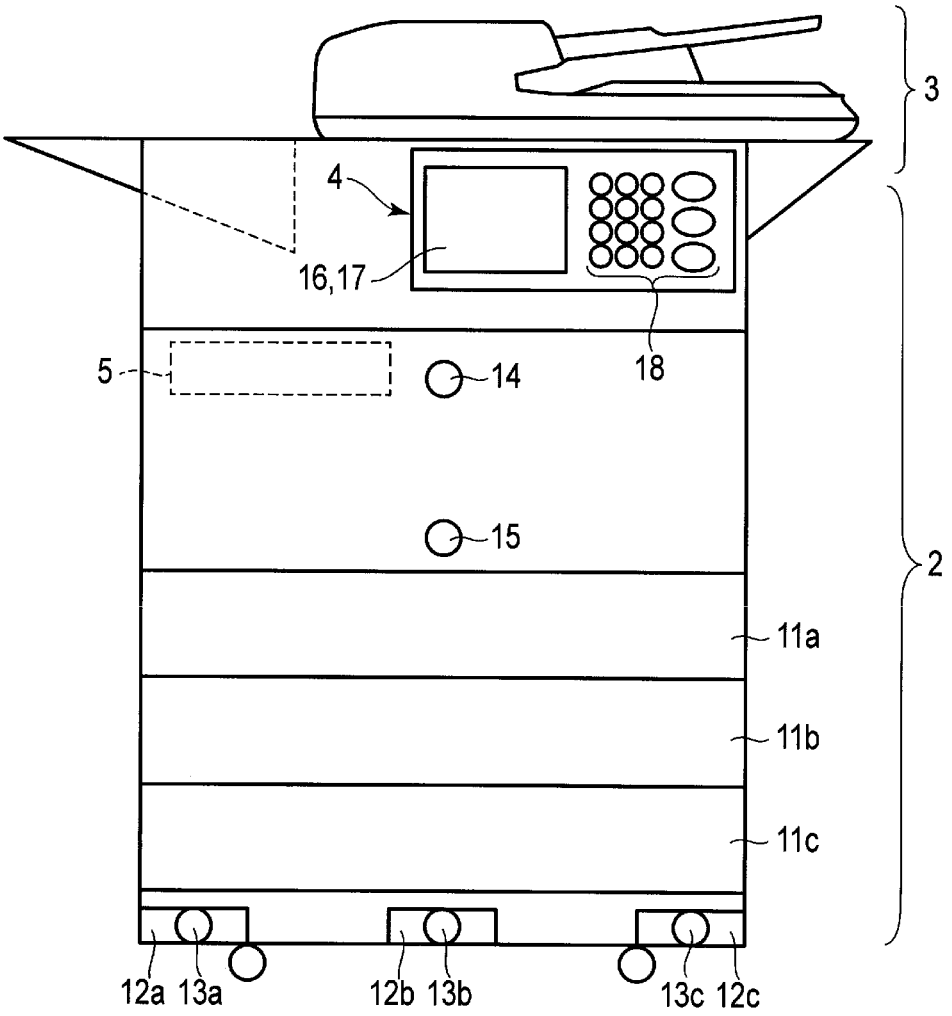
FIG. 1 schematically illustrates an image forming apparatus according to an embodiment.

FIG. 1 schematically illustrates a configuration example of a multi-functional peripheral 1 serving as the image forming apparatus according to the embodiment.

As illustrated in FIG. 1, a multi-functional peripheral (MFP) 1 according to the embodiment has a printer 2, a scanner 3, an operation panel 4, and a system control unit 5.

The multi-functional peripheral 1 has one or more cassettes 11 (three are shown: 11*a*, 11*b*, and 11*c*), one or more motion sensors (hereinafter, simply referred to as a sensor) 12 (three are shown: 12*a*, 12*b*, and 12*c*), one or more LEDs 13 (three are shown: 13*a*, 13*b*, and 13*c*), a camera 14, and an ultrasonic sensor 15.

The printer 2 forms an image on a sheet serving as a recording medium. The printer 2 feeds the sheet from the cassette 11, and forms the image on the fed sheet. The printer 2 is not limited to a specific image forming process. For example, the printer 2 may employ an electrographic process, an inkjet process, or a thermal transfer process.

The scanner 3 is an image reading device which reads an image of a document and converts the image into image data. In the configuration example illustrated in FIG. 1, the scanner 3 is installed in an upper portion of a main body of the multi-functional peripheral 1. The scanner 3 reads the image of the document placed in a document table. The scanner 3 may read the image of the document fed by an auto document feeder (ADF).

The operation panel 4 is a user interface. The operation panel 4 has a display unit 16, a touch panel 17, and an operation button 18. The operation panel 4 is controlled by the system control unit 5. For example, the operation panel 4 outputs information that has been input to the touch panel 17 or the operation button 18, to the system control unit 5. The operation panel 4 displays various messages on the display unit 16 in accordance with an instruction output from the system control unit 5.

The system control unit 5 performs controlling and data processing of each unit in the multi-functional peripheral 1. For example, if copying is performed, the system control unit 5 causes the printer 2 to print the image of the document read by the scanner 3 on the sheet. In order to perform an operation (to be described later), the system control unit 5 receives a detection signal from each sensor 12 or the ultrasonic sensor 15, or receives the image captured by the camera 14. The system control unit 5 controls an operation of various drive mechanisms disposed in the cassette 11, or turns on each LED 13.

The cassettes 11*a*, 11*b*, and 11*c* accommodate sheets serving as the recording medium on which the printer 2 forms an image. The cassettes 11*a*, 11*b*, and 11*c* accommodate different types of sheets whose sizes are respectively set. The motion sensors 12*a*, 12*b*, and 12*c* and the LEDs 13*a*, 13*b*, and 13*c* are respectively disposed corresponding to the cassettes 11*a*, 11*b*, and 11*c*.

The motion sensors 12*a*, 12*b*, and 12*c* detect a motion of a user. For example, the motion sensors 12*a*, 12*b*, and 12*c* are turned on and off by a toe of the user. The motion sensors 12*a*, 12*b*, and 12*c* are configured to include an MA motion sensor. In the configuration example illustrated in FIG. 1, the motion sensors 12*a*, 12*b*, and 12*c* are disposed in a lower portion of an apparatus body. In one example, a single motion sensor 12 may be used.

The one or more LEDs 13 (13*a*, 13*b*, and 13*c*) is a light emitter which emits light visible to the user. The one or more LEDs 13 (13*a*, 13*b*, and 13*c*) is disposed in association with the one or more motion sensors 12 (12*a*, 12*b*, and 12*c*) or the one or more cassettes 11 (11*a*, 11*b*, and 11*c*). In the configuration example illustrated in FIG. 1, the LEDs 13*a*, 13*b*, and 13*c* are respectively and integrally formed with the motion sensors 12*a*, 12*b*, and 12*c*. That is, in the configuration illustrated in FIG. 1, each lighting position of the LEDs 13*a*, 13*b*, and 13*c* is configured to be each detection position of the sensors 12*a*, 12*b*, and 12*c*.

The camera 14 and the ultrasonic sensor 15 function as each sensor for detecting a person present in front of the apparatus. The camera 14 and the ultrasonic sensor 15 also function as each distance sensor which measures a distance to the person present in front of the apparatus. In the configuration example illustrated in FIG. 1, the multi-functional peripheral 1 includes the camera 14 and the ultrasonic sensor 15. In this case, the camera 14 captures an image for determining whether or not a person is present in front of the multi-functional peripheral 1. The ultrasonic sensor 15 captures an image for measuring a distance to the person present in front of the multi-functional peripheral 1.

The camera 14 sets an area in front of the apparatus as an imaging range, and captures the image in the imaging range. Based on the image captured by the camera 14, the system control unit 5 determines whether or not a person is present in front of the multi-functional peripheral 1. The ultrasonic sensor 15 detects information indicating the distance to the person (target) present in front of the multi-functional peripheral 1. Based on the information detected by the ultrasonic sensor 15, the system control unit 5 measures the distance to the person present in front of the multi-functional peripheral 1.

The system control unit 5 may measure the distance to the person present in front of the multi-functional peripheral 1, based on the image captured by the camera 14. The system control unit 5 may determine whether or not the person is present in front of the multi-functional peripheral 1, based on a detection signal output by the ultrasonic sensor 15. That is, according to such an embodiment, the multi-functional peripheral 1 may can detect whether or not a person is present in front of the apparatus and can measure a distance to the person who is present.

Next, a configuration of the respective cassettes 11*a*, 11*b*, and 11*c* will be described.

Figure 2:
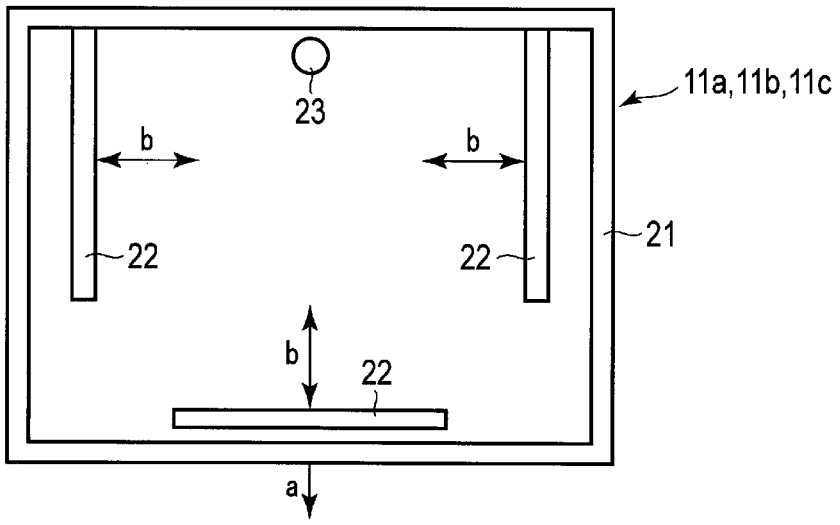
FIG. 2 illustrates a configuration example of a cassette.

FIG. 2 illustrates a configuration example of the cassettes 11*a*, 11*b*, and 11*c*.

The one or more cassettes 11 (11*a*, 11*b*, and 11*c*) each have a respective case 21 (21*a*, 21*b*, and 21*c*), a respective guide 22 (22*a*, 22*b*, and 22*c*), and a respective sheet sensor 23 (23*a*, 23*b*, and 23*c*).

The one or more cases 21 (21*a*, 21*b*, and 21*c*) are each a housing which forms the cassette. The one or more cases 21 (21*a*, 21*b*, and 21*c*) are accommodated inside the main body of the multi-functional peripheral 1 in a state where the sheet is set therein. The one or more cases 21 (21*a*, 21*b*, and 21*c*) are withdrawn (opened) from the main body of the multi-functional peripheral 1, to facilitating feeding or loading of sheets therein. For example, each of the one or more cases 21 (21*a*, 21*b*, and 21*c*) re withdrawn in a direction indicated by an arrow "a" illustrated in FIG. 2, thereby bringing each of the one or more cases 21 (21*a*, 21*b*, and 21*c* into a state where the sheet can be set (fed). Each of the one or more cases 21 (21*a*, 21*b*, and 21*c*) is withdrawn (brought into an open state) from the main body of the multi-functional peripheral 1 by an opening mechanism 56 illustrated in FIG. 3 (to be described later).

Figure 3:
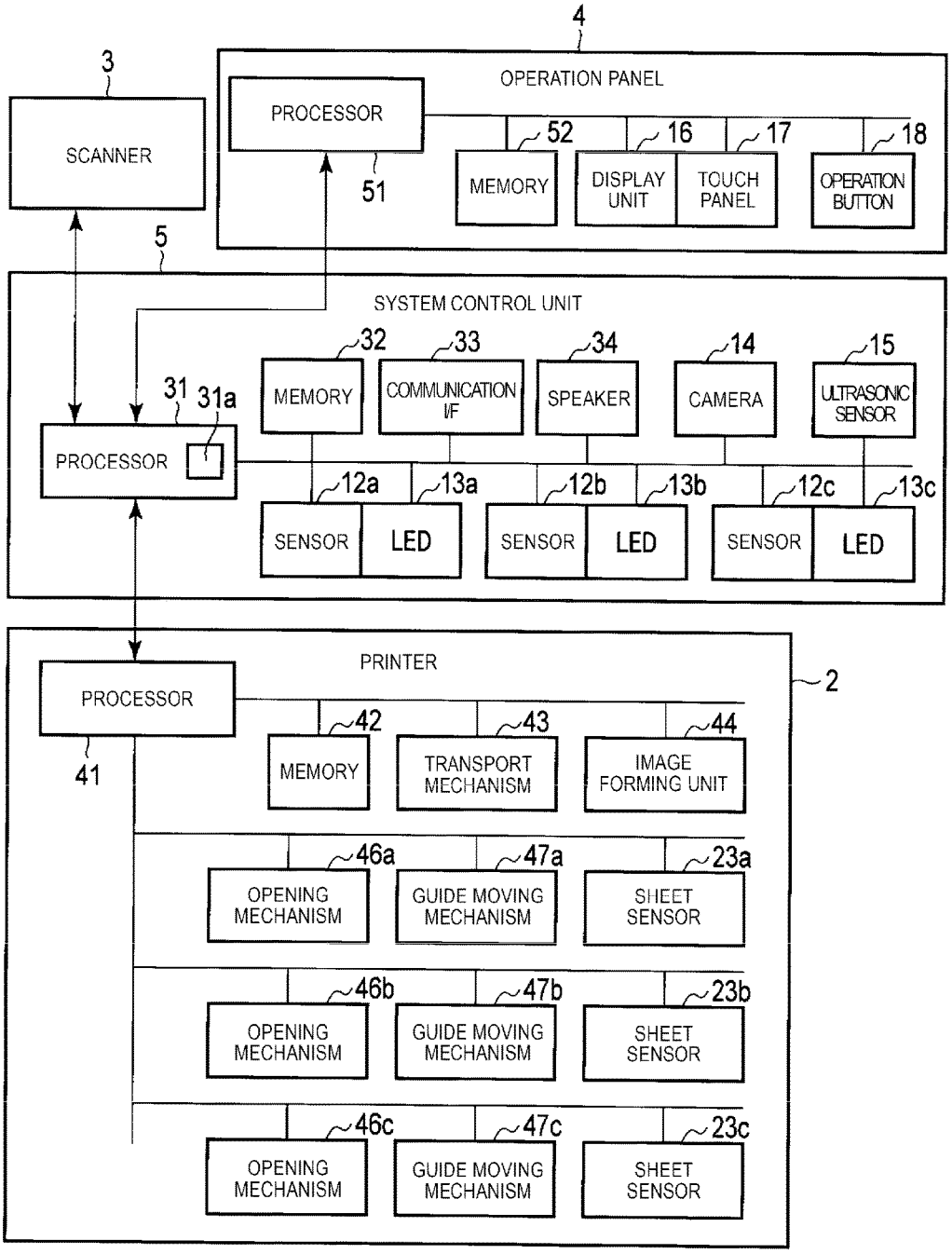
FIG. 3 is a block diagram schematically illustrating a configuration example of a control system in each unit.

Each of the one or more guides 22 (22*a*, 22*b*, and 22*c*) is a member for aligning the sheets inside the case 21. In the example illustrated in FIG. 2, the one or more guides 22 (22*a*, 22*b*, and 22*c*) of each respective cassette 11 includes three sub-members, each moving in a direction indicated by an arrow b. Each of the one or more guides 22, or the sub-members thereof, includes and/or is driven by a guide drive mechanism 57, as illustrated in FIG. 3. For example, upon feeding of a sheet by a user, the guide 22 is brought into a state where the guide 22 moves to the maximum width in the opened case 21. After the user positions the sheet, the guide 22 is moved to a position corresponding to a size of the sheet.

The one or more sheet sensors 23 (23*a*, 23*b*, and 23*c*) detect the presence or absence of a sheet. The one or more sheet sensors 23 (23*a*, 23*b*, and 23*c*) may be any sensor as long as the one or more sheet sensors 23 (23*a*, 23*b*, and 23*c*) can detect the presence or absence of the sheet inside a respective cassette 11. The one or more sheet sensors 23 (23*a*, 23*b*, and 23*c*) may be optical sensors whose output signal varies depending on the presence or absence of the sheet, or may be mechanical switches which are turned on and off depending on the presence or absence of a sheet.

Next, a configuration of a control system of the multi-functional peripheral will be described.

FIG. 3 is a block diagram schematically illustrating a configuration example of the control system in each unit of the multi-functional peripheral 1.

In the configuration example illustrated in FIG. 3, the system control unit 5 has a processor 31, a memory 32, a communication interface (I/F) 33, and a speaker 34. The processor 31 is connected to each motion sensor 12 (12*a*, 12*b*, and 12*c*), each LED 13 (13*a*, 13*b*, and 13*c*), the camera 14, and the ultrasonic sensor 15.

The processor 31 is connected to the printer 2, the scanner 3, and the operation panel 4 via an interface. The processor 31 fulfills various processing functions by executing a program stored in the memory 32. For example, the processor 31 executes the program stored in the memory 32, thereby outputting an operation instruction to each unit and acquiring various information items from each unit. The processor 31 has a clock 31*a* for measuring elapsed time.

The memory 32 includes a memory such as a random access memory (RAM), a read only memory (ROM), and data memory. The RAM functions as a working memory or a buffer memory. The ROM is a rewriting-unavailable nonvolatile memory. The ROM functions as a program memory. The data memory is a rewritable nonvolatile memory.

The communication I/F 33 exchanges data with an external device. For example, the communication I/F 33 functions as an image acquisition unit that acquires the image to be printed on the sheet from the external device such as a PC. The communication I/F 33 also functions as an interface for communicating with a server (to be described later).

The speaker 34 outputs a sound such as a warning sound. For example, the speaker 34 issues an alert sound under the control of the processor 31.

Each of the motion sensors 12 (12*a*, 12*b*, and 12*c*) supplies a detection signal indicating a motion detection result to the processor 31. For example, each of the motion sensors 12 (12*a*, 12*b*, and 12*c*) outputs an on-signal if each of the motion sensors 12 (12*a*, 12*b*, and 12*c*) detects that a toe of the person moves in front of a motion sensor 12 (12*a*, 12*b*, and 12*c*), and outputs an off-signal in other cases. The processor 31 determines the motion of a person by using a signal output from each of the motion sensors 12 (12*a*, 12*b*, and 12*c*).

Each LED 13 (13*a*, 13*b*, and 13*c*) is lit in response to a control signal output from the processor 31. For example, each LED 13 (13*a*, 13*b*, and 13*c*) is turned on or off in response to the control signal output from the processor 31.

The camera 14 captures an image by setting a region (region where each cassette is withdrawn) in front of the multi-functional peripheral 1 as an imaging range. The camera 14 supplies the captured image to the processor 31. Based on the image captured by the camera 14, the processor 31 determines the presence or absence of the person or the distance to the person (position of the person).

The ultrasonic sensor 15 outputs a signal indicating the distance to the person. For example, as illustrated in FIG. 1, the ultrasonic sensor 15 is disposed on a front surface of the multi-functional peripheral 1 (surface on a side to which each cassette 11 (11*a*, 11*b*, 11*c*) is withdrawn). Based on a signal output from the ultrasonic sensor 15, the processor 31 determines the presence or absence of the person in front of the multi-functional peripheral 1, or measures the distance to the person.

Next, a configuration example of a control system in the printer 2 will be described.

As illustrated in FIG. 3, the printer 2 has a processor 41, a memory 42, a transport mechanism 43, an image forming unit 44, one or more opening mechanisms 46 (46*a*, 46*b*, and 46*c*), one or more guide moving mechanisms 47 (47*a*, 47*b*, and 47*c*), and a sheet sensor 23.

The processor 41 realizes various processes by executing a program stored in the memory 42. For example, the processor 41 executes the program so as to control an operation of each unit in the printer 2, and monitors an operation state of each unit. The processor 41 is connected to the processor 31 of the system control unit 5 via an interface. The processor 41 executes various processes in accordance with an operation instruction output from the system control unit 5.

The memory 42 includes a memory such as a random access memory (RAM), a read only memory (ROM), and data memory. The RAM functions as a working memory or a buffer memory. The ROM is a rewriting-unavailable nonvolatile memory. The ROM functions as a program memory. The data memory is a rewritable nonvolatile memory.

The transport mechanism 43 transports the sheet taken out from the cassette 11 inside the printer 2. The transport mechanism 43 drives a transport roller disposed in each unit inside the printer 2 in accordance with an operation instruction output from the processor 41.

The image forming unit 44 forms the image on the sheet. The image forming unit 44 may form the image on the sheet fed from any of the cassettes 11 (11*a*, 11*b*, 11*c*), and is not limited to a specific image forming process. However, in the embodiment described herein, description is made on the assumption that an electrographic process is used. The image forming unit 44 using the electrographic process forms an electrostatic latent image on a photoconductive drum, and develops the electrostatic latent image formed on the photoconductive drum with a toner having each color. The image forming unit 44 transfers a toner image obtained by developing the electrostatic latent image with toner onto the sheet, and causes a fixing unit to fix the toner image transferred to the sheet.

The one or more opening mechanisms 46 (46*a*, 46*b*, and 46*c*) are each a drive mechanism for opening (withdrawing) the case 21 of a respective cassette 11 (11*a*, 11*b*, 11*c*) from the main body of the multi-functional peripheral 1. The opening mechanism 46 opens the case 21 upon receiving an opening instruction to open a cassette 11 (11*a*, 11*b*, 11*c*) from the processor 31 via the processor 41. Each opening mechanism 46 (46*a*, 46*b*, 46*c*) may have at least a mechanism for opening the case 21 from the main body of the multi-functional peripheral 1. Each opening mechanism 46 (46*a*, 46*b*, 46*c*) may be a drive mechanism which accommodates the case 21 inside the main body of the multi-functional peripheral 1.

The guide moving mechanisms 47 (47*a*, 47*b*, and 47*c*) move each respective guide 22 (22*a*, 22*b*, 22*c*) disposed inside the case 21 of the cassette 11. The guide moving mechanisms 47 (47*a*, 47*b*, and 47*c*) move each respective guide 22 (22*a*, 22*b*, 22*c*) in accordance with an instruction output from the processor 31. However, the guide moving mechanisms 47 (47*a*, 47*b*, 47*c*) may be configured so that sub-members of each respective guide 22 (22*a*, 22*b*, 22*c*) can be brought into a most spread state (e.g., greatest spacing therebetween) when each respective case 21 (21*a*, 21*b*, and 21*c*) is opened. For example, the guide moving mechanisms 47 (47*a*, 47*b*, 47*c*) may have a mechanical structure so that each respective guide 22 (22*a*, 22*b*, 22*c*) spreads in response to the opening of respective case 21 (21*a*, 21*b*, and 21*c*).

The sheet sensor 23 supplies a signal indicating the presence or absence of a sheet to the processor 41. The processor 41 supplies the signal indicating the presence or absence of the sheet inside a cassette 11 (11*a*, 11*b*, 11*c*) corresponding to the signal of the sheet sensor 23, to the processor 31.

Next, a configuration example of a control system in the operation panel 4 will be described.

As illustrated in FIG. 3, the operation panel 4 has a processor 51, a memory 52, a display unit 16, the touch panel 17, and the operation button 18.

The processor 51 realizes various processes by executing a program stored in the memory 52. For example, the processor 51 executes the program so as to control an operation of each unit in the operation panel 4, and monitors an operation state of each unit. The processor 51 is connected to the processor 31 of the system control unit 5 via an interface. For example, the processor 51 notifies the system control unit 5 of information input by a user.

The memory 52 includes a memory such as a random access memory (RAM), a read only memory (ROM), and data memory. The RAM functions as a working memory or a buffer memory. The ROM is a rewriting-unavailable nonvolatile memory. The ROM functions as a program memory. The data memory is a rewritable nonvolatile memory.

The display unit 16 displays a message. The display unit 16 displays display content as instructed by the processor 31 via the processor 51. The touch panel 17 is disposed on a display screen of the display unit 16, and detects a position touched on the display screen. For example, the touch panel 17 detects a selection instruction of an icon displayed by the display unit 16. The processor 31 identifies information input by the user in accordance with the touched position detected by the touch panel 17.

The operation button 84 is configured to include a hardware key such as a numeric key, a start key, and a reset key.

Next, an operation example corresponding to a sheet feeding operation for each cassette 11 (11*a*, 11*b*, 11*c*) in the multi-functional peripheral 1 will be described.

Figure 4:
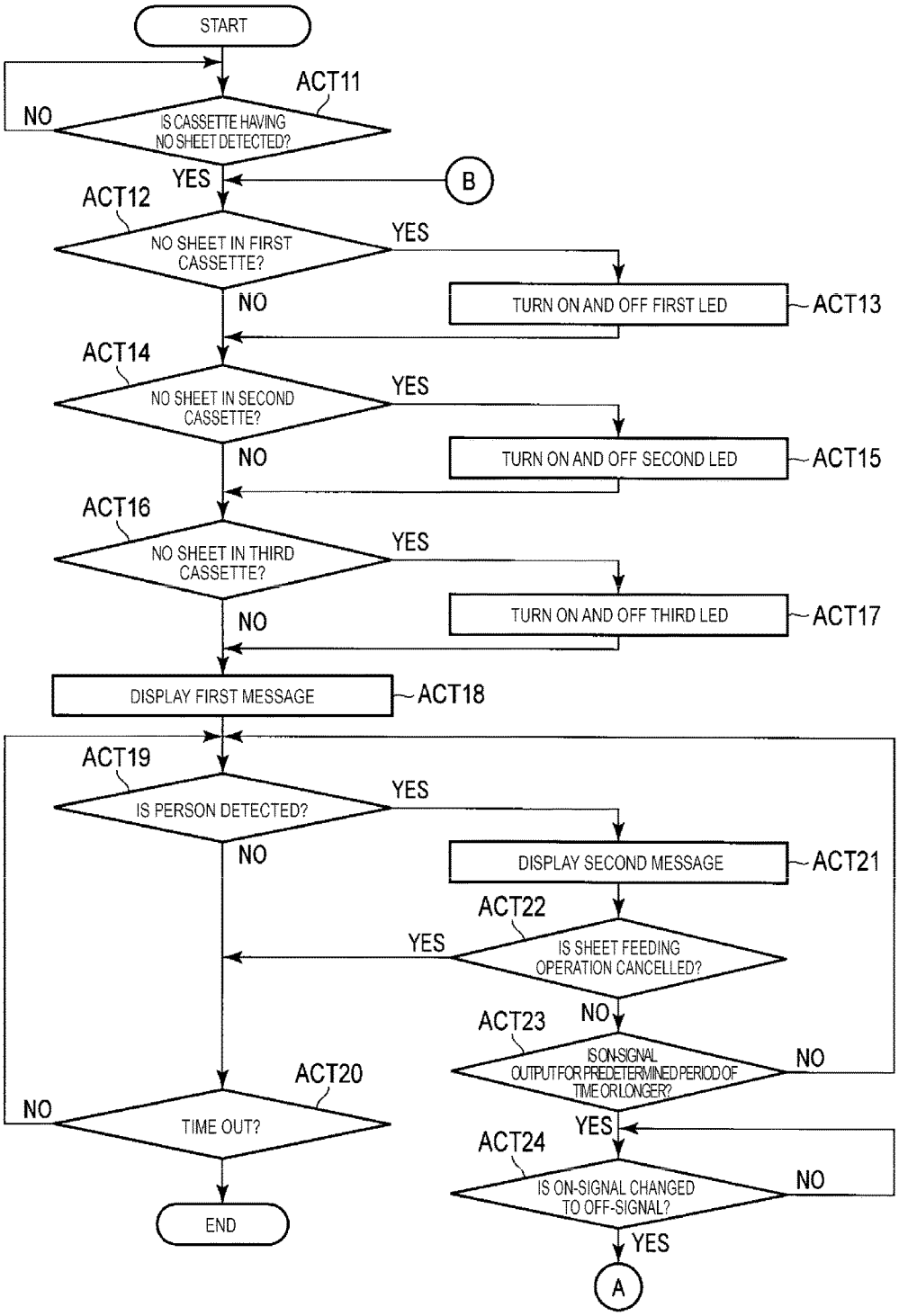
FIG. 4 is a flowchart for describing an operation example corresponding to a sheet feeding operation for the cassette.
Figure 5:
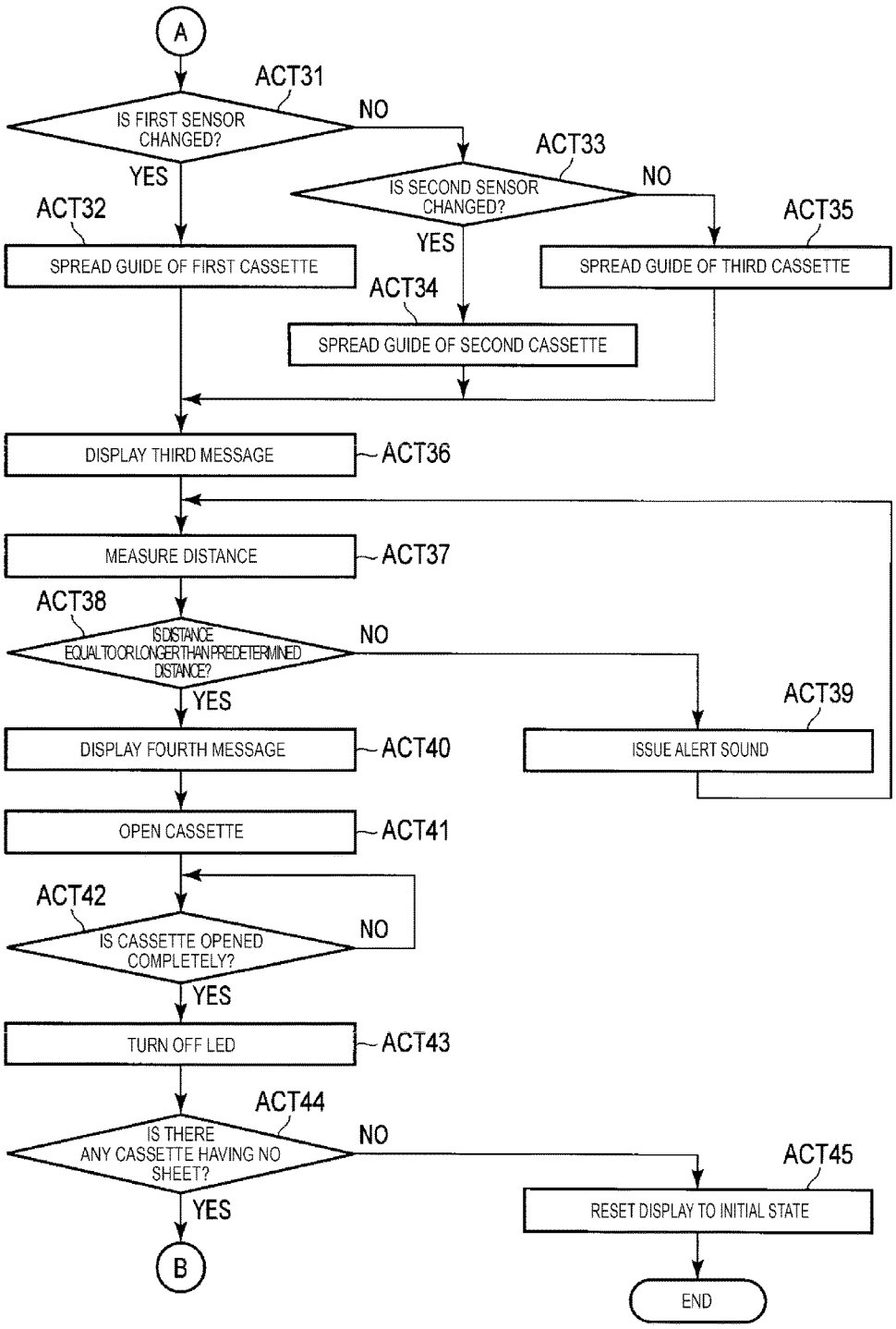
FIG. 5 is a flowchart for describing an operation example corresponding to the sheet feeding operation for the cassette.

FIGS. 4 and 5 are flowcharts for describing the operation example corresponding to the sheet feeding operation for each cassette 11 in the multi-functional peripheral 1. FIGS. 6 to 9 respectively illustrate display examples of messages displayed by the display unit 16 in the sheet feed operation.

The processor 31 of the system control unit 5 monitors the absence of the sheet in each cassette by using a detection signal of the sheet sensor 23 of each cassette 11 (ACT 11).

If no sheet is detected (ACT 11, YES), the processor 31 determines whether the first cassette 11*a* has no sheet, based on the detection signal of the sheet sensor 23*a* (ACT 12). If the processor 31 determines that the first cassette 11*a* has no sheet (ACT 12, YES), the processor 31 repeatedly turns on and off (i.e., flashes) the first LED 13*a* corresponding to the first cassette 11*a* (ACT 13). If the first LED 13*a* is turned on and off, the processor 31 enables the motion sensor 12*a* corresponding to the first cassette 11*a*. In this manner, the processor 31 can determine whether a user instructs the first cassette 11*a* to open with a toe motion, based on a signal from the motion sensor 12*a*.

Based on a detection signal of the sheet sensor 23*b*, the processor 31 determines whether the second cassette 11*b* has no sheet (ACT 14). If the processor 31 determines that the second cassette 11*b* has no sheet (ACT 14, YES), the processor 31 repeatedly turns on and off (i.e., flashes) the second LED 13*b* corresponding to the second cassette 11*b* (ACT 15). If the second LED 13*b* is turned on and off, the processor 31 enables the motion sensor 12*b* corresponding to the second cassette 11*b*. In this manner, the processor 31 can determine whether a user instructs the second cassette 11*b* to open with a toe motion, based on a signal from the motion sensor 12*b*.

Based on a detection signal of the sheet sensor 23*c*, the processor 31 determines whether the third cassette 11*c* has no sheet (ACT 16). If the processor 31 determines that the third cassette 11*c* has no sheet (ACT 16, YES), the processor 31 repeatedly turns on and off (i.e., flashes) the third LED 13*c* corresponding to the third cassette 11*c* (ACT 17). If the third LED 13*c* is turned on and off, the processor 31 enables the motion sensor 12*c* corresponding to the third cassette 11*c*. In this manner, the processor 31 can determine whether the user instructs the third cassette 11*c* to open with a toe motion, based on a signal from the motion sensor 12*c*.

While LEDs are described herein as flashing, it is contemplated that other signaling methodologies may be employed, such as constant illumination of the LEDs.

After checking the presence or absence of the sheet in each cassette 11 (11*a*, 11*b*, 11*c*), the processor 31 causes the display unit 16 to display a message (first message) to feed sheets to the cassette having no sheets therein (ACT 18). For example, as the first message, the processor 31 causes the display unit 16 to display a guide notifying that a cassette has no sheets therein, or a guide to a sheet feeding procedure.

Figure 6:
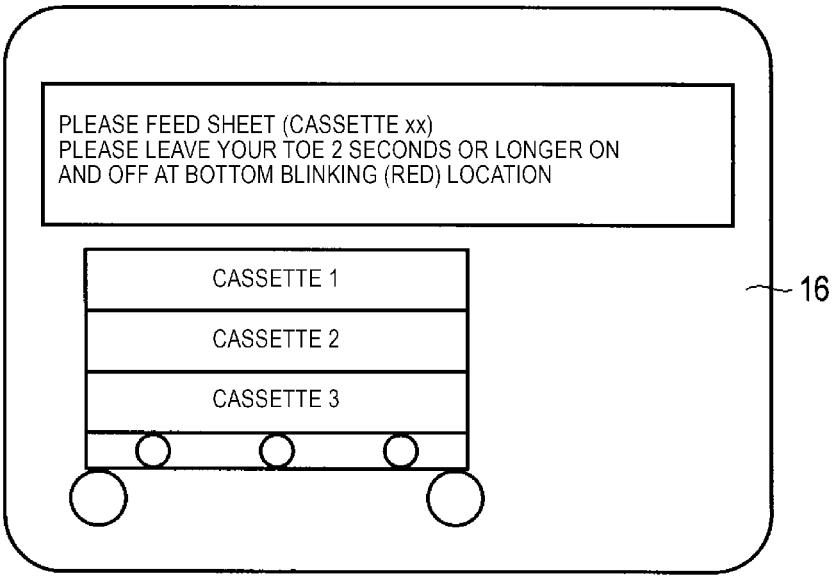
FIG. 6 illustrates a display example of a first message displayed by a display unit.

FIG. 6 illustrates a display example of the first message displayed by the display unit 16.

In the example illustrated in FIG. 6, the display unit 16 displays "please feed sheet (cassette xx)" as a guide prompting a user to feed sheets to the cassette having no sheets therein. As the guide to the sheet feeding procedure for feeding sheets to the cassette having no sheets therein, the display unit 16 displays a message of "please leave your toe 2 seconds or longer on and off at the bottom blinking (red) location". Furthermore, in the example illustrated in FIG. 6, the display unit 16 also displays illustrations for specifying the cassette.

After displaying the first message, the processor 31 detects a person present in front of the main body of the multi-functional peripheral 1, as a standby state of the sheet feeding operation (ACT 19). For example, the processor 31 determines whether the person is present in front of the main body of the multi-functional peripheral 1 by detecting the person from an image captured by the camera 14. The processor 31 may determine whether the person is present in front of the main body of the multi-functional peripheral 1, based on a detection signal of the ultrasonic sensor 15.

The processor 31 also has a function to stop (cancel) the standby state of the sheet feeding operation when a user does not perform the sheet feeding operation. That is, after detecting that a cassette has no sheets therein, the processor 31 stops the standby state of the sheet feeding operation if an elapsed time in a state where the person is not detected exceeds a timeout period (ACT 20, YES). If the user instructs the operation panel 4 to cancel the sheet feeding operation (ACT 21, YES), the processor 31 stops the standby state of the sheet feeding operation. This operation control is performed on the assumption that in some actual operation cases, the user may not immediately perform the sheet feeding operation for feeding the sheet to the cassette having no sheets therein.

If the processor 31 determines that the person is present (ACT 19, YES), the processor 31 causes the display unit 16 to display a message (second message) to guide a user in performing the operation for opening the cassette (ACT 22). For example, as the second message, the processor 31 causes the display unit 16 to display a guide for a user to interact with the motion sensor corresponding to the cassette having no sheets therein.

Figure 7:
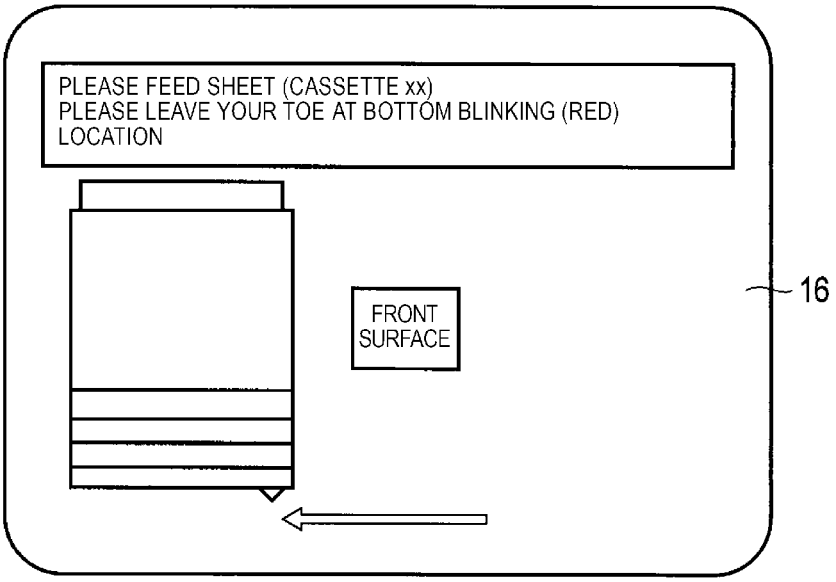
FIG. 7 illustrates a display example of a second message displayed by the display unit.

FIG. 7 illustrates a display example of the second message displayed by the display unit 16.

In the example illustrated in FIG. 7, as a guide for the motion (operation) of the user interacting with the motion sensor 12 corresponding to the cassette having no sheets therein, the display unit 16 displays a message of "please leave your toe 2 seconds or longer on and off at the bottom blinking (red) location". As a guide generated in response to a cassette having no sheets therein, the display unit 16 also displays a guide of "please feed the sheet (cassette xx)". In order to intuitively show the motion (operation) of the user, the display unit 16 graphically illustrates the motion of the user interacting with the motion sensor 12 by using an illustration. In such an illustration, the multi-functional peripheral 1 is laterally viewed.

After determining that the person is present (ACT 19, YES), the processor 31 causes the enabled motion sensor 12 to detect a specific motion of the person. Here, as the specific motion, the processor 31 detects a leaving motion (for example, a motion of moving for 2 seconds or more, and then moving away) after the person moves in front of the motion sensor 12 for a predetermined period of time (for example, 2 seconds) or longer. That is, the processor 31 detects whether an object (for example, including the toe of the person) is continuously in motion in front of the motion sensor 12 for a predetermined period of time or longer (ACT 23). Here, the motion sensor 12 outputs an on-signal in a state (on-state) where the object such as the toe of the person moves in front of the motion sensor 12, and outputs an off-signal in a state (off-state) where the object moves away from the motion sensor 12. In this case, the processor 31 determines whether the motion sensor 12 continuously outputs the on-signal for a predetermined period of time or longer.

After determining that the on-signal is continuously output for the predetermined period of time or longer (ACT 23, YES), the processor 31 further detects whether the output of the motion sensor 12 is changed to the off-signal (ACT 24). That is, as the specific motion of the user, the processor 31 detects that the motion sensor 12 is turned off after being continuously turned on for the predetermined period of time or longer. For example, if the toe of the user moves away after continuously pressing the motion sensor 12 for the predetermined period of time or longer, the processor 31 determines that the user has made a specific motion.

If the motion sensor 12 is turned off (the specific motion is detected) after being continuously turned on for the predetermined period of time or longer (ACT 24, YES), the processor 31 specifies whether the motion sensor 12 corresponds to a respective cassette 11 (11*a*, 11*b*, 11*c*).

If the motion sensor 12*a* serving as the first sensor detects the specific motion (ACT 31, YES), the processor 31 specifies the cassette 11*a* as a target of the sheet feeding operation. If the cassette 11*a* is the target of the sheet feeding operation, the processor 31 causes the guide 22*a* of the cassette 11*a* to spread to a maximum size (ACT 32).

If the motion sensor 12*b* serving as the second sensor detects the specific motion (ACT 33, YES), the processor 31 specifies the cassette 11*b* as the target of the sheet feeding operation. If the cassette 11*b* is the target of the sheet feeding operation, the processor 31 causes the guide 22*b* of the cassette 11*b* to spread to a maximum size (ACT 34).

If the motion sensor 12*c* serving as the third sensor detects the specific motion (ACT 33, NO), the processor 31 specifies the cassette 11*c* as the target of the sheet feeding operation. If the cassette 11*c* is the target of the sheet feeding operation, the processor 31 causes the guide 22*c* of the cassette 11*c* to spread to a maximum size (ACT 35).

When a configuration is adopted which includes only one motion sensor 12 installed therein, the processor 31 may specify the cassette which finally supplies the sheet to the image forming unit 44, as the target of the sheet feeding operation. In this manner, if there is no sheet during a printing process, the cassette 11*a*, 11*b*, or 11*c* used in response to the specific motion detected by the motion sensor 12 can be set as the target of the sheet feeding operation.

If a cassette 11*a*, 11*b*, or 11*c* is specified as the target of the sheet feeding operation, the processor 31 causes the display unit 16 to display a third message to guide for opening the cassette (ACT 36). For example, as the third message, the processor 31 causes the display unit 16 to display a guide notifying a position of the user which corresponds to the cassette 11*a*, 11*b*, or 11*c* to be opened.

Figure 8:
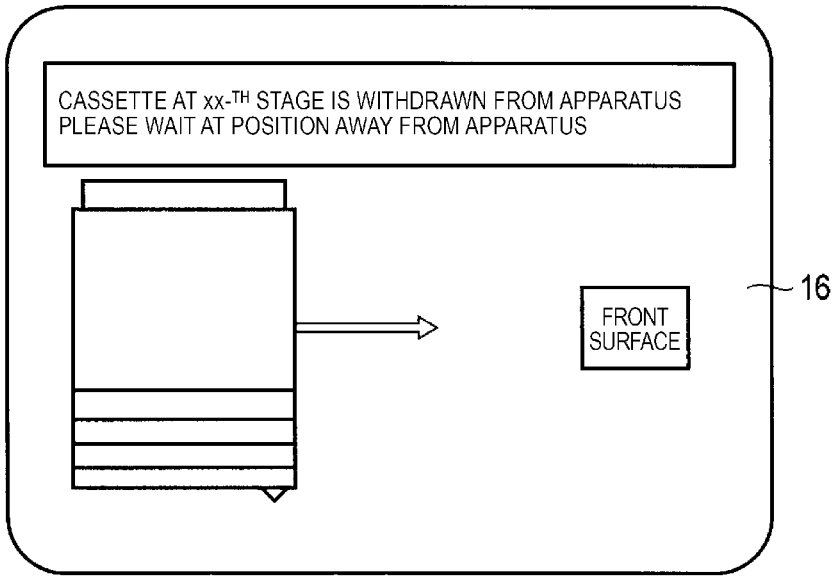
FIG. 8 illustrates a display example of a third message displayed by the display unit.

FIG. 8 illustrates a display example of the third message displayed by the display unit 16.

In the example illustrated in FIG. 8, as the guide indicating the cassette 11*a*, 11*b*, or 11*c* to be opened, the display unit 16 displays a guide of "the cassette at the $xx^{-th}$ stage is withdrawn from the apparatus". As a guide for securing a space to open the cassette, the display unit 16 also displays a guide of "please wait at a position away from the apparatus". Furthermore, in order to intuitively show the motion (operation) of the user, the display unit 16 graphically illustrates an opening direction of the cassette by using an illustration where the multi-functional peripheral 1 is laterally viewed.

If respective cassette 11*a*, 11*b*, or 11*c* is specified as the target of the sheet feeding operation, the processor 31 causes the ultrasonic sensor 15 to measure a distance to the user (person in front of the multi-functional peripheral 1) (ACT 37). The processor 31 specifies the distance from the front surface of the multi-functional peripheral 1 to the user, based on a detection signal output from the ultrasonic sensor 15. The processor 31 may additionally or alternatively specify the distance to the user, based on an image captured by the camera 14.

If the distance to the user is measured, the processor 31 determines whether the measured distance to the user is equal to or longer than a predetermined distance (ACT 37). Here, the predetermined distance is set to a value which can secure the space (distance) required for opening the cassette. In other words, the predetermined distance is set to a value so that the person (user) present in front of the multi-functional peripheral 1 does not touch the cassette when opened.

If the distance to the user is shorter than the predetermined distance (ACT 38, NO), the processor 31 causes the speaker 34 to output an alert in order to draw attention of the user (ACT 39). The alert is a warning sound to prompt the user to move away from the multi-functional peripheral 1. In this manner, the user is prompted to move away from the multi-functional peripheral 1 not only by using the display but also by using the warning sound.

If the distance to the user is equal to or longer than the predetermined distance (ACT 38, YES), the processor 31 causes the display unit 16 to display a fourth message notifying that the cassette is opened (ACT 40).

Figure 9:
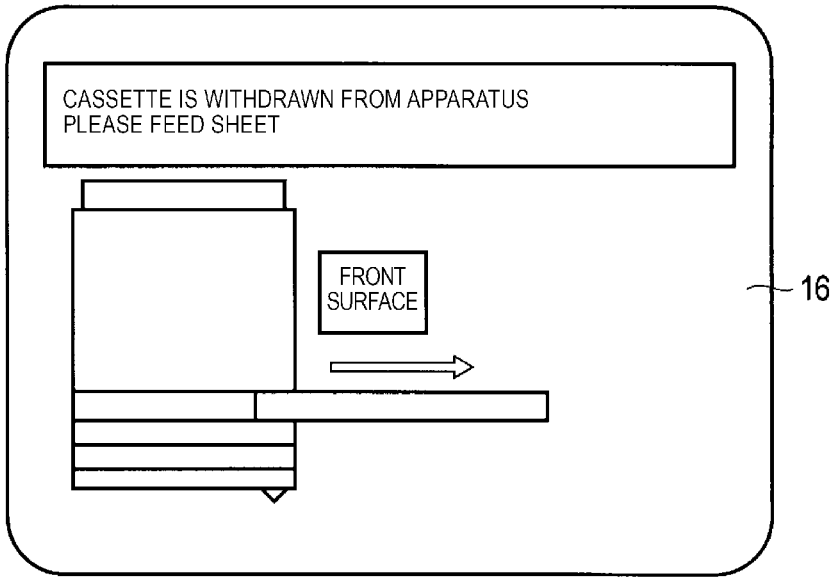
FIG. 9 illustrates a display example of a fourth message displayed by the display unit.

FIG. 9 illustrates a display example of the fourth message displayed by the display unit 16.

In the example illustrated in FIG. 9, as a guide for notifying that the cassette is opened, the display unit 16 displays a guide of "the cassette is withdrawn from the apparatus". As a guide to prompt the user to feed the sheets to the cassette 11*a*, 11*b*, or 11*c* to be opened, the display unit 16 also displays a guide of "please feed sheet". Furthermore, in order to intuitively show the cassette 11*a*, 11*b*, or 11*c* to be opened, the display unit 16 graphically illustrates the cassette 11*a*, 11*b*, or 11*c* to be opened, by using an illustration where the multi-functional peripheral 1 is laterally viewed.

If the processor 31 determines that the distance to the user is equal to or longer than the predetermined distance (ACT 38, YES), the processor 31 performs an operation for opening the specified cassette 11 (11*a*, 11*b*, or 11*c*) (ACT 41). That is, the processor 31 instructs the opening mechanism 46 of the specified cassette 11 (11*a*, 11*b*, or 11*c*) to open the respective cassette 11 (11*a*, 11*b*, or 11*c*). A respective opening mechanism 46 (46*a*, 46*b*, 46*c*) is driven in accordance with an instruction output from the processor 31, thereby delivering the case 21 of the corresponding cassette 11*a*, 11*b*, 11*c* from the inside of the main body of the multi-functional peripheral 1 to the front side.

Once a cassette 11*a*, 11*b*, 11*c* is opened, the user feeds the one or more sheets to the case 21 of the opened cassette 11*a*, 11*b*, or 11*c*. Once the sheets are fed, the user sets a position of a respective guide 22 (22*a*, 22*b*, or 22*c*) so as to be aligned with a size of the fed sheets, and sets the cassette 11 (11*a*, 11*b*, or 11*c*) inside the main body. The guide 22 (22*a*, 22*b*, or 22*c*) of the cassette 11 (11*a*, 11*b*, 11*c*) to which sheets are fed may be moved to a position corresponding to the size of the sheets fed by a respective guide moving mechanism 47 (47*a*, 47*b*, 47*c*). The case 21 of the cassette 11 (11*a*, 11*b*, or 11*c*) to which the sheets are fed may be set inside the main body by the opening mechanism 46.

If the opened cassette 11 (11*a*, 11*b*, 11*c*) is set inside the main body of the multi-functional peripheral 1 (ACT 42, YES), the processor 31 turns off the LED 13 corresponding to the cassette 11 (11*a*, 11*b*, 11*c*) set inside the main body (ACT 43). If the cassette 11 (11*a*, 11*b*, 11*c*) is set inside the main body, the processor 31 checks whether there is the cassette 11 (11*a*, 11*b*, 11*c*) having no sheets therein (ACT 44). If the processor 31 determines that there is a cassette 11 (11*a*, 11*b*, 11*c*) having no sheets therein (ACT 44, YES), the processor 31 returns to ACT 12, and performs the above-described process again. If the processor 31 determines that there is no cassette 11 (11*a*, 11*b*, 11*c*) having no sheets therein (ACT 44, NO), the processor 31 switches the guide screen displayed by the display unit 16 to a standby state screen, and completes the process (ACT 45).

Through the above-described processes, the multi-functional peripheral 1 can realize an operation which can improve convenience of the user in the sheet feeding operation for feeding the sheet to a cassette having no sheets therein.

MODIFICATION EXAMPLE

The embodiment has been described above as an operation example corresponding to the sheet feeding operation for feeding sheets to a cassette of the multi-functional peripheral. However, the embodiment is also applicable as an operation corresponding to an operation for feeding other members to the multi-functional peripheral. For example, it is assumed that the above-described image forming unit 44 uses an electrographic method. The image forming unit 44 using the electrographic method performs an operation for feeding a toner (image forming material) used for developing an electrostatic latent image. For example, the toner is accommodated in an exchangeable cartridge, and is set inside the main body of the multi-functional peripheral 1. In this case, the toner feeding operation is performed by a user who exchanges the cartridge accommodating the toner.

The cartridge of the toner is in an exchangeable state by pulling out the cartridge from the inside of the main body after opening a front surface panel of the multi-functional peripheral 1. In order to employ the above-described embodiment, the multi-functional peripheral is provided with a drive mechanism for moving the cartridge to the exchangeable state, and a motion sensor and an LED which correspond to the cartridge. According to this configuration, when the toner runs out, if the motion sensor detects a specific motion of a user, the system control unit 5 can perform control for moving the cartridge to the exchangeable state, thereby facilitating replacement of the cartridge.

Even if the image forming unit 44 uses another image forming method, the image forming unit may include a mechanism for bringing (or feeding the image forming material) the cartridge accommodating the image forming material into the exchangeable state (or alternatively, a state where the image forming material can be fed). For example, if the image forming unit 44 uses an inkjet method, the image forming unit 44 may be provided with a drive mechanism that brings the cartridge accommodating the ink into the exchangeable state, and a motion sensor and an LED which correspond to the cartridge. In this case, if the motion sensor detects a specific motion of a user when after the ink runs out, the system control unit 5 can perform control for bringing the cartridge into the exchangeable state.

According to the embodiment described above, the image forming apparatus has the plurality of cassettes, and a motion sensor and LED (light emitter) correspond to each cassette. The image forming apparatus turns on the LED corresponding to the cassette having no sheets therein, if the cassette has no more sheets. The image forming apparatus causes the display unit to display guidance to guide sheet feeding into the empty. In the image forming apparatus, if the motion sensor corresponding to the turned-on LED detects a specific motion, the cassette having no sheets therein is opened, and is brought into a state where sheets can be fed to the empty cassette.

In this manner, the image forming apparatus can open the cassette in response to the specific motion made by the user who feeds the sheet to the cassette having no sheets therein. For example, in the image forming apparatus, if the motion sensor detects the specific motion of the toe of the user, the image forming apparatus can open the cassette. As a result, even if the user holds the sheets to be fed with the hands (even if both hands are occupied), the cassette can be opened without using the hands, and the feeding operation can be easily performed.

The image forming apparatus described herein also includes a distance sensor that measures the distance to a person. The image forming apparatus confirms whether a space (distance) where the cassette can be opened (withdrawn) is secured by the distance to the person which is measured by the distance sensor. In a state of confirming that the distance to the person which is measured by the distance sensor secures the space where the cassette can be opened, the image forming apparatus opens the cassette in response to the specific motion detected by the motion sensor. In this manner, it is possible to prevent the cassette from being opened into contact with the user.

Furthermore, the image forming apparatus issues an alert sound notifying the user to move away from the cassette, if the distance to the person which is measured by the distance sensor cannot secure the space where the cassette can be opened. In this manner, the user who is likely to come into contact with the cassette if the cassette is opened can be notified to move away from the cassette.

Furthermore, the image forming apparatus has a guide that moves depending on the size of the sheet so as to align the sheets accommodated inside the cassette, and a guide moving mechanism that moves the guide. The image forming apparatus causes the guide moving mechanism to spread the position of the guide to the maximum position, when opening the cassette having no sheets therein. In this manner, the user can smoothly set the sheets in the opened cassette, and can easily perform the operation for feeding a large-sized sheet.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming unit configured to form an image on a sheet;

a cassette configured to accommodate sheets to be supplied to the image forming unit;

an opening mechanism configured to open the cassette;

a motion sensor configured to detect a motion of a person;

a processor configured to control the opening mechanism to open the cassette in response to the motion sensor detecting a specific motion of a person; and a distance sensor configured to measure a distance from the cassette to an object located in an opening direction of the cassette, wherein after the motion sensor detects the specific motion of the person, if the distance measured by the distance sensor is equal to or greater than a predetermined distance, the processor controls the opening mechanism to open the cassette.

2. The apparatus according to claim 1, further comprising:

a display unit, wherein after the motion sensor detects the specific motion of the person, if the distance measured by the distance sensor is shorter than the predetermined distance, the processor causes the display unit to display a guidance message instructing the person to move away from the cassette.

3. The apparatus according to claim 1, wherein the processor is configured to cause an alert sound to be issued if the distance measured by the distance sensor is shorter than the predetermined distance.

4. The apparatus according to claim 1, wherein the specific motion includes activating the motion sensor for at least a predetermined period of time and then inactivating the motion sensor.

5. The apparatus according to claim 1, further comprising:

a second cassette and a second motion sensor, wherein the motion sensor and the second motion sensor correspond to the cassette and the second cassette, respectively, and wherein the specific motion detected by the motion sensor or the second motion results in the processor causing the corresponding cassette or second cassette to be opened.

6. The apparatus according to claim 1, further comprising:

a light emitter that corresponds to the motion sensor, the light emitter generating a signal if there is no sheet inside the cassette.

7. The apparatus according to claim 1, further comprising:

a sheet guide that is disposed inside the cassette.

8. The apparatus according to claim 7, wherein the sheet guide is opened to a maximum position in response to the cassette being opened.

9. A method of controlling an image forming apparatus, comprising:

detecting that absence of a sheet within a cassette of the image forming apparatus;

in response to detecting the absence of the sheet, displaying a guidance message instructing a person to feed additional sheets to the cassette;

detecting a motion of a person;

measuring a distance from the cassette to an object located in an opening direction of the cassette; and opening the cassette, after detecting the motion of the person, if the measured distance is equal to or longer than a predetermined distance.

10. The method according to claim 9, further comprising:

activating an LED adjacent a detection area of a motion sensor of the image forming apparatus.

11. The method according to claim 10, further comprising:

displaying a message requesting a user to move away from the cassette if the distance is less than the predetermined distance.

12. The method according to claim 11, further comprising:

issuing an alert sound if the distance measured by the distance sensor is shorter than the predetermined distance.

13. The method according to claim 12, further comprising:

activating a motion sensor in response to detecting the presence of the person.

14. The method according to claim 13, wherein the presence of the person is detected by capturing an image of the person with a camera.

15. The method of claim 14, wherein the motion is a specific motion, and the specific motion includes activating the motion sensor for a predetermined period of time or longer and then inactivating the motion sensor.

16. The method according to claim 9, wherein the image forming apparatus includes a plurality of cassettes and a plurality of motion sensors, each motion sensor of the plurality of motion sensors corresponding to one of the plurality of cassettes.

17. The method according to claim 9, further comprising:

generating a signal with a light emitter in response to detecting the absence of the sheet within the cassette.

18. The method according to claim 9, wherein the image forming apparatus includes a sheet guide in the cassette, and wherein the sheet guide opens to a maximum position upon opening of the cassette.

* * * * *